US007284818B2

(12) United States Patent
Yoshida et al.

(10) Patent No.: US 7,284,818 B2
(45) Date of Patent: Oct. 23, 2007

(54) LIQUID INJECTION APPARATUS

(75) Inventors: Atsushi Yoshida, Nagano-ken (JP); Shozo Kuwada, Nagano-ken (JP)

(73) Assignee: Sieko Epson Corporation, Tokyo (JP)

( * ) Notice: Subject to any disclaimer, the term of this patent is extended or adjusted under 35 U.S.C. 154(b) by 281 days.

(21) Appl. No.: 10/817,433

(22) Filed: Apr. 5, 2004

(65) Prior Publication Data

US 2004/0263559 A1 Dec. 30, 2004

(30) Foreign Application Priority Data

Apr. 4, 2003 (JP) ..... 2003-101871
Oct. 1, 2003 (JP) ..... 2003-343748

(51) Int. Cl.
*B41J 2/165* (2006.01)

(52) U.S. Cl. ..... 347/29; 347/30; 347/32

(58) Field of Classification Search ..... 347/22–36
See application file for complete search history.

(56) References Cited

FOREIGN PATENT DOCUMENTS

JP 2000-255075 A 9/2000
JP 2001-26113 A 1/2001

*Primary Examiner*—Manish S. Shah
*Assistant Examiner*—Ly T. Tran
(74) *Attorney, Agent, or Firm*—Sughrue Mion, PLLC

(57) ABSTRACT

An inkjet recording device includes a recording head and a cap placed in tight contact with a nozzle forming surface for defining a sealed space. A head moving mechanism moves the recording head along a direction in which the nozzle forming surface is extended, toward or separately from a contact position at which the cap is placed in tight contact with the recording head. A cap moving mechanism moves the cap toward or separately from the contact position at which the cap is placed in tight contact with the nozzle forming surface. A cap holding mechanism including a slider holds the cap such that the cap is allowed to slide along a moving direction of the recording head and positions the cap at the contact position.

9 Claims, 14 Drawing Sheets

Fig. 16(a)
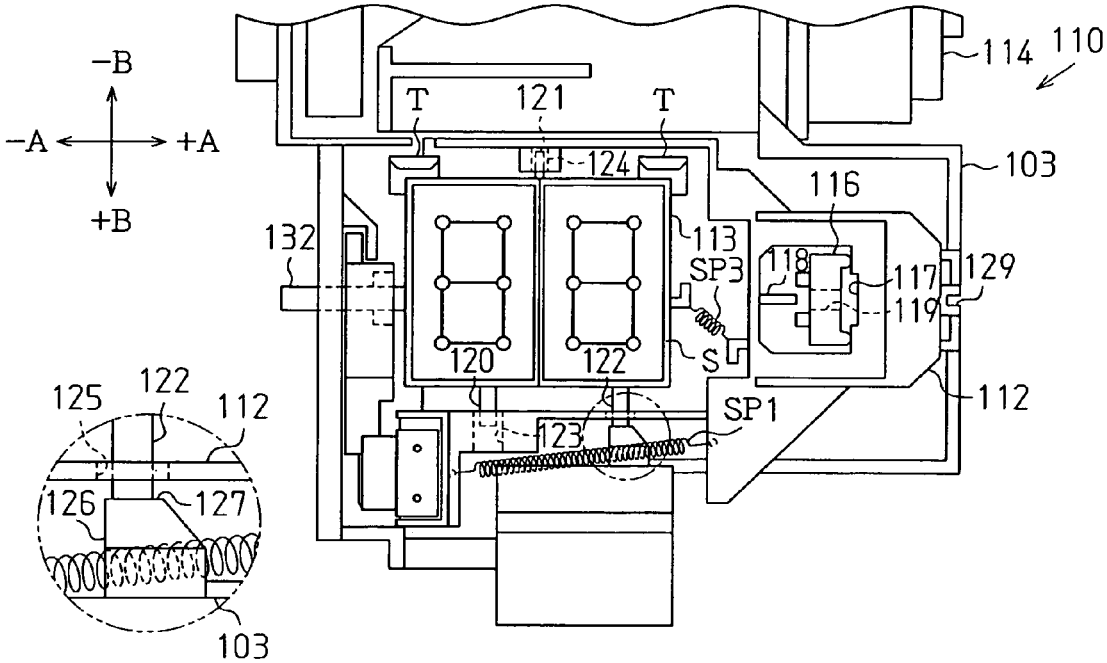
Fig. 16(b)
Fig. 17(a)
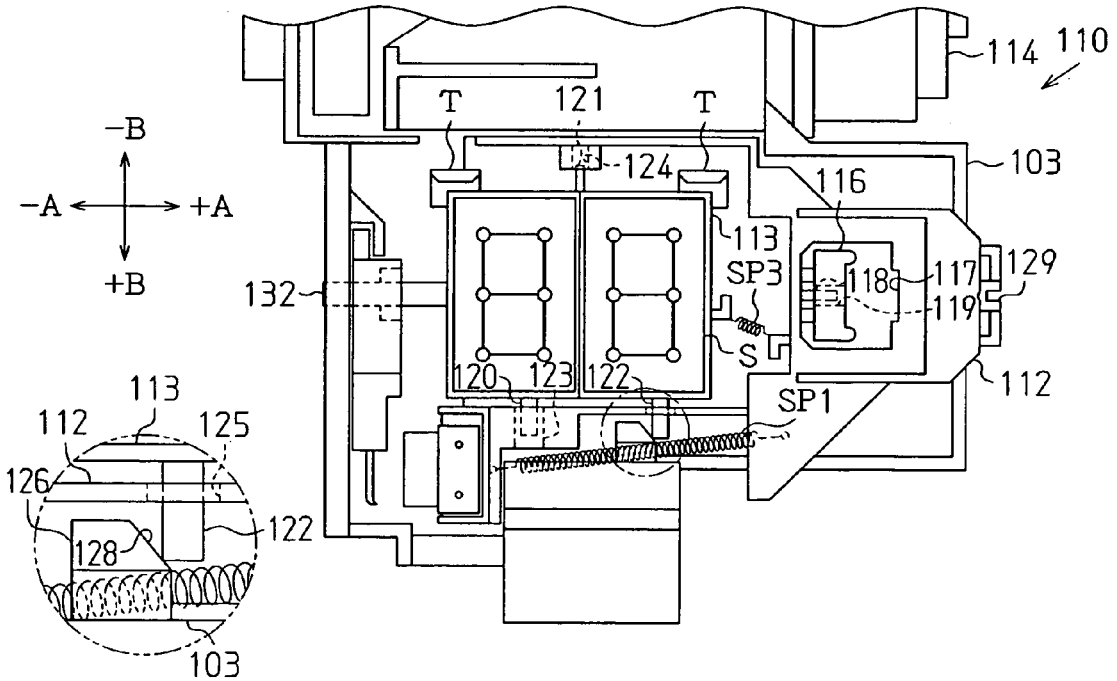
Fig. 17(b)

LIQUID INJECTION APPARATUS

BACKGROUND OF THE INVENTION

The present invention relates to a liquid injection apparatus including a recording head for injecting liquid.

Conventionally, a liquid injection apparatus injecting liquid by a desired method is known. For example, an ink-jet recording device serving as a liquid injection apparatus injects ink, which is liquid, from a plurality of nozzles formed in the recording head, thus forming an image such as a character on a recording surface.

To ensure a smooth operation of the recording head, a cap is pressed against a nozzle forming surface (a liquid injecting surface) of the recording head in order to define a sealed space. This prevents the recording head from becoming dry and from being contaminated by, for example, dusts.

For example, Japanese Laid-Open Patent Publication No. 2001-26113 discloses a liquid injection apparatus having a cap movable toward the recording head. To assure that the cap is reliably placed in tight contact with the nozzle forming surface, the cap is guided along a slanted surface of a guide extension in a sliding manner. The cap is thus positioned with high accuracy.

In this liquid injection apparatus, the recording head is reciprocated in a horizontal direction, while the cap is moved upward. However, for example, if the recording head is moved horizontally with the cap maintained in tight contact with the nozzle forming surface, the sealed space cannot be maintained. Further, the cap or recording head may be damaged. To avoid the problem, the liquid injection apparatus employs a mechanism for separating the cap from the recording head when the recording head moves.

The liquid injection apparatus starts to move the recording head for detecting the position of the recording head, for example, when the device is turned on. At this stage, the cap must be separated from the recording head. However, as above described, the recording head must be protected from dryness and contamination. Therefore, when the recording head is stopped, it is preferred that the cap maintain the liquid injecting surface of the recording head in a sealed state for avoiding the exposure to the ambient air.

In addition, for example, Japanese Laid-Open Patent Publication No. 2000-255075 discloses an inkjet recording device having a maintenance unit 1000, as illustrated in FIGS. 25 to 27. The maintenance unit 1000 automatically cleans the recording head. The maintenance unit 1000 includes a carriage 1040, a recording head 1050, and a non-illustrated wiping member. The recording head 1050 is formed in the carriage 1040. The wiping member is formed from, for example, an elastic material. The wiping member wipes ink from a nozzle forming surface of the recording head 1050. Alternatively, the ink may be drawn from and discharged from a nozzle of the recording head 1050 as needed. This structure maintains a preferable communication between an ink passage and the opening of the nozzle. With the maintenance unit 1000, the inkjet recording device decreases the incidence of insufficient ink injection caused by clogging of the nozzle.

With reference to FIG. 25, the maintenance unit 1000 has a cap unit 1030 rotationally supported by a base 1010 through an arm 1020. The cap unit 1030 includes a cap 1060 that seals the recording head 1050. The cap unit 1030 also includes a pair of capping guide extensions 1070 for guiding the recording head 1050 and a pair of flushing guide extensions 1080, which are formed at opposing sides of the cap 1060. The guide extensions 1080 are axially larger than the capping guide extensions 1070.

A contact piece 1090 is formed in the carriage 1040. A flag piece 1100 and a projection 1110 are formed in the cap unit 1030. When the carriage 1040 moves rightward as viewed in FIG. 25 and the contact piece 1090 contacts the flag piece 1100, the projection 1110 also moves rightward as guided by a guide 1120 formed in the base 1010. The cap 1060 thus opposes the recording head 1050 of the carriage 1040 as shown in FIG. 26. At this stage, the recording head 1050 contacts the flushing guide extensions 1080. This arrangement forms a clearance L between the recording head 1050 and the cap 1060. In this state, the recording head 1050 is located immediately above the cap 1060 and is permitted to perform flushing.

If the carriage 1040 moves further rightward from the state of FIG. 26, the arm 1020 is pivoted, as shown in FIG. 27. The recording head 1050 is guided by the capping guide extensions 1070, and the cap 1060 contacts the recording head 1050. This seals the recording head 1050 from the exterior.

This configuration regulates the position of the recording head 1050 to the position at which the cap 1060 reliably receives the ink discharged through flushing. Further, when capping is performed, the recording head 1050 and the cap member 1060 are reliably positioned relative with each other with high accuracy.

When flushing is performed, the recording head 1050 contacts the flushing guide extensions 1080, as illustrated in FIG. 26. The contact may cause an impact that generates a noise. Further, with reference to FIG. 27, when the recording head 1050 is sealed from the exterior, the recording head 1050 contacts the capping guide extensions 1070. Also in this case, the contact may cause an impact generating a noise. It is thus difficult to provide an inkjet recording device that operates silently as long as the device includes the maintenance unit 1000.

In addition, in order assuredly form the clearance L for flushing, the maintenance unit 1000 must be provided with the flushing guide extensions 1080. This structure limits the layout of the maintenance unit 1000.

SUMMARY OF THE INVENTION

Accordingly, it is a first objective of the present invention to suppress deterioration of liquid to be injected. It is a second objective of the present invention to provide a liquid injection apparatus that operates silently.

To achieve the foregoing and other objectives and in accordance with the purpose of the present invention, the invention provides a liquid injection apparatus. The liquid injection apparatus has a liquid injecting head and a cap. The liquid injecting head includes a liquid injecting surface. The liquid injecting head is movable along a direction in which the surface injecting surface is extended. The cap is placed in tight contact with the liquid injecting surface for defining a sealed space. The liquid injecting head is allowed to move toward or away from a contact position at which the cap is placed in tight contact with the liquid injecting head. The cap is allowed to move along a direction crossing the liquid injecting surface toward or away from the contact position at which the cap is placed in tight contact with the liquid injecting surface. The cap is also allowed to move in a plane parallel to the liquid injecting surface.

The present invention provides another liquid injection apparatus. The liquid injection apparatus includes a liquid injecting head, a head moving mechanism, and a cap moving mechanism. The liquid injecting head has a liquid injecting surface. The cap is placed in tight contact with the liquid injecting surface for defining a sealed space. The head moving mechanism moves the liquid injecting head along a direction in which the liquid injecting surface is extended, such that the liquid injecting head is allowed to move toward or away from a contact position at which the cap is placed in tight contact with the liquid injecting head. The cap moving mechanism moves the cap toward or away from the contact position at which the cap is placed in tight contact with the liquid injecting surface. The cap moving mechanism includes a cap holding mechanism for holding the cap in a state slidable along a moving direction of the liquid injecting head and positioning the cap at the contact position.

The present invention provides another liquid injection apparatus. The liquid injection apparatus includes a liquid retaining portion, a liquid injecting head, a cap, and a maintenance unit. The liquid retaining portion retains liquid. The liquid injecting head injects the liquid supplied from the liquid retaining portion in a predetermined injecting zone. The cap seals the liquid injecting head outside the liquid injecting zone. The maintenance unit discharges the liquid injected by the liquid injecting head through the interior of the cap. The cap is placed at a reference position at which the cap is escaped from the path of the liquid injecting head when the liquid injecting head is moved in the injecting zone. The cap is placed at a set position at which the cap opposes the liquid injecting head when the liquid injecting head is moved outside the liquid injecting zone.

Other embodiments of the invention, together with advantages thereof, will become apparent by reference to the following description together with the drawings illustrating the principles of the present invention by way of example.

BRIEF DESCRIPTION OF THE DRAWINGS

The characteristics of the present invention believed to be novel will become apparent in the attached claims. The invention, together with objectives and advantages thereof, may best be understood by reference to the following description of the presently preferred embodiments together with the accompanying drawings in which:

FIG. 16 is a plan view explaining the configuration of the maintenance unit of FIG. 15;

FIG. 17 is another plan view explaining the configuration of the maintenance unit of FIG. 15;

DETAILED DESCRIPTION OF THE PREFERRED EMBODIMENTS

A first embodiment of the present invention will now be described with reference to FIGS. 1 to 13.

Figure 1:
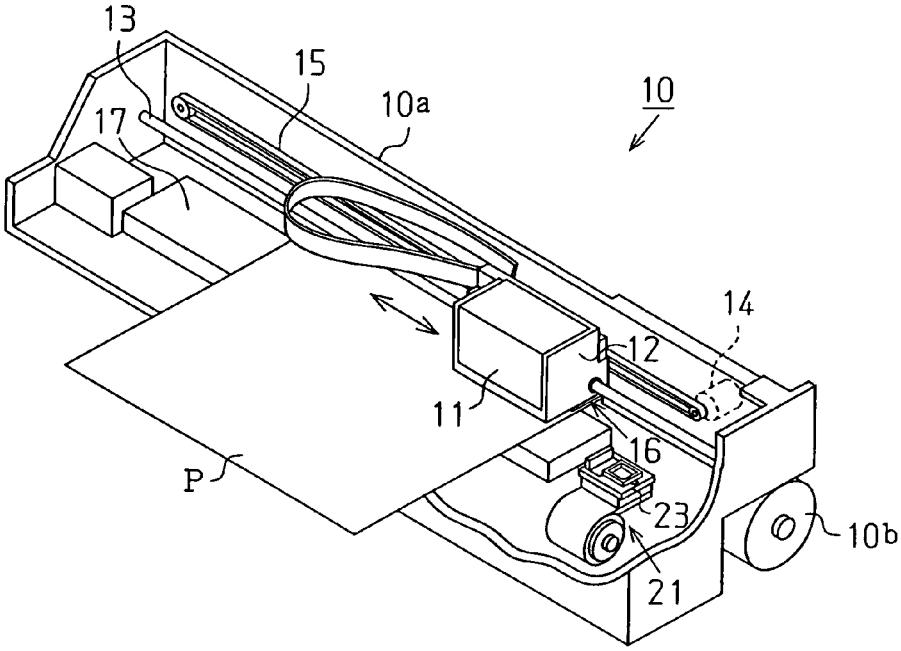
FIG. 1 is a perspective view showing an inkjet recording device of a first embodiment of a liquid injection apparatus according to the present invention.
Figure 2:
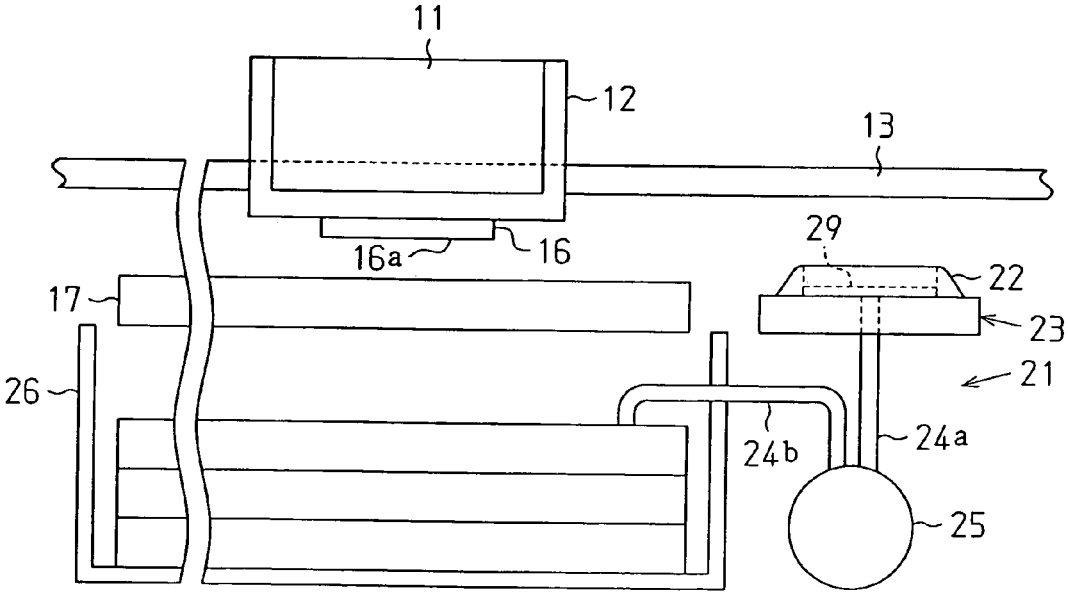
FIG. 2 is a plan view schematically showing a main mechanism of the device of FIG. 1.

As shown in FIGS. 1 and 2, an inkjet recording device 10, or a liquid injection apparatus, includes a frame 10*a* and an ink cartridge 11. The frame 10*a* is shaped substantially as a rectangular parallelepiped. The ink cartridge 11 serves as a liquid retaining portion retaining three primary color inks and a black ink. The ink cartridge 11 is accommodated in a carriage 12. The carriage 12 is reciprocated along a guide 13 in a main scanning direction (as indicated by the arrows of FIG. 1), as driven by a motor 14 through a belt 15. In the first embodiment, the guide 13, the motor 14, and the belt 15 form a head moving mechanism.

The inkjet recording device 10 includes a platen 17 that is supported by the frame 10*a* and extends in the main scanning direction. A recording sheet P is supplied to the platen 17 by a non-illustrated paper supply mechanism having a paper supply motor 10*b*. A recording head 16 serving as a liquid injecting head is formed at the bottom of the carriage 12. The recording head 16 has a plurality of non-illustrated nozzles. The nozzles inject ink from the ink cartridge 11 to the recording paper P in a selective manner in accordance with printing data. An image such as a character is thus formed on a recording surface of the recording paper P. In this embodiment, the recording head 16 injects the ink by a pressurizing method involving displacement of a piezoelectric element. However, the ink injection of the recording head 16 may be performed by a pressurizing method involving heating and vaporization with a heater.

As shown in FIG. 1, the inkjet recording device 10 has a head cleaning device 21 at a position opposing an end of the platen with respect to the main scanning direction of the carriage 12 (a cleaning position). With reference to FIG. 2, the head cleaning device 21 has a cap mechanism 23 and a tube pump 25. The cap mechanism 23 presses a cap 22 against a nozzle forming surface (a liquid injecting surface) 16*a*, the bottom side of the recording head 16, for defining a sealed space. The tube pump 25 selectively draws or discharges fluid through a first flexible tube 24*a* and a second flexible tube 24*b*. The first tube 24*a*, which corresponds to an upstream side, connects the sealed space defined by the cap mechanism 23 with the tube pump 25. The second tube 24*b*, which corresponds to a downstream side, connects the tube pump 25 with a discharged ink tray (a discharge receptacle) 26.

To assure that a smooth recording operation is repeatedly performed, the head cleaning device 21 includes a timing mechanism that operates the cap mechanism 23 and the tube pump 25 at predetermined timings. That is, the flexible tube 24*a* and the sealed space defined by the cap 22 are depressurized through suction. The ink is thus drawn from the nozzles of the recording head 16 and is discharged to the discharged ink tray 26. In this manner, head cleaning is completed.

Figure 3:
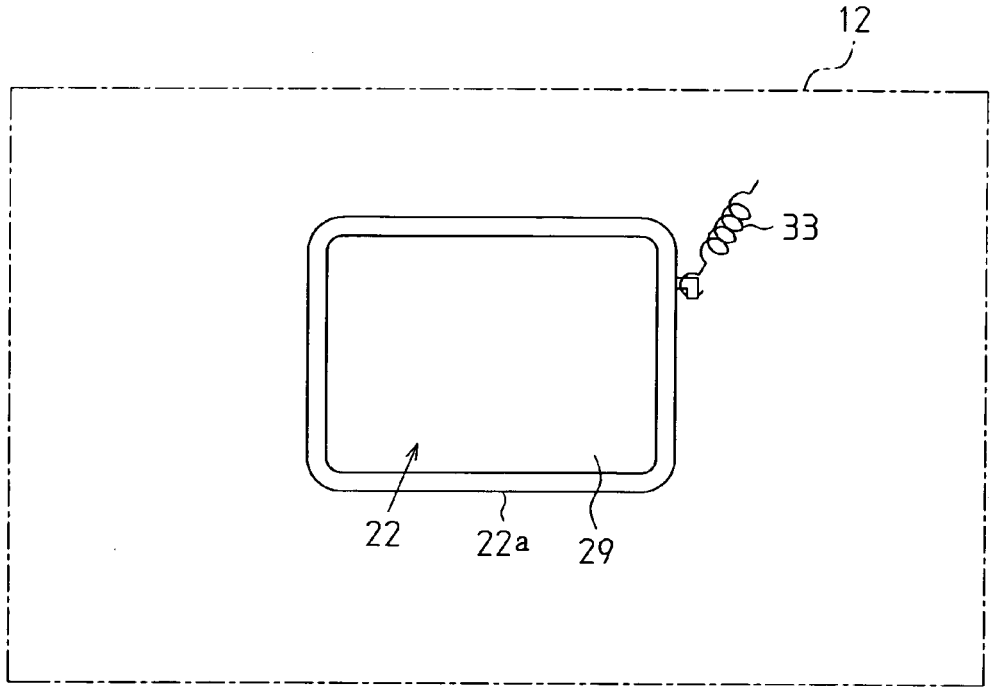
FIG. 3 is a partially perspective plan view showing the positions of members constituting a main part of the device of FIG. 1.
Figure 4:
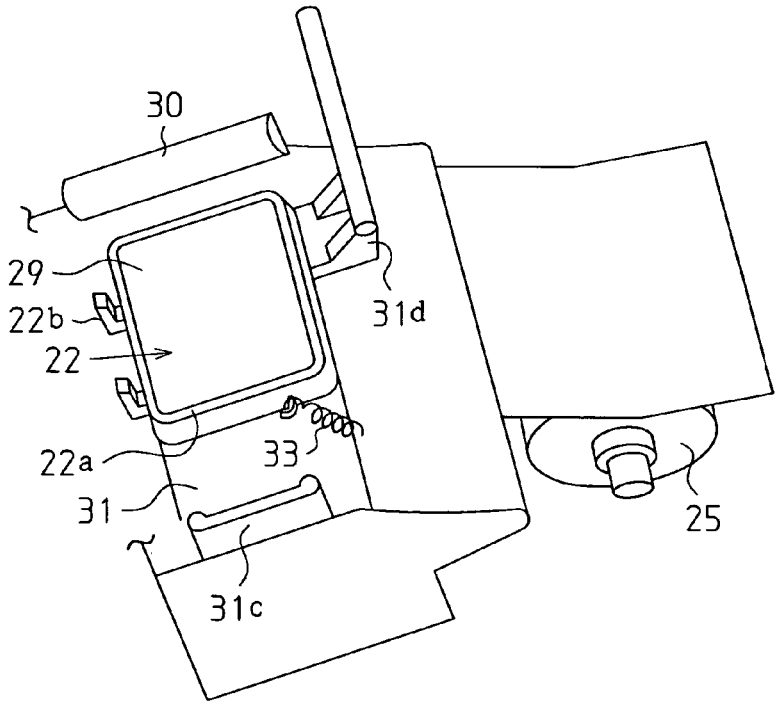
FIG. 4 is a perspective view showing the main mechanism of the device of FIG. 1.

With reference to FIGS. 2 to 4, the cap 22 has an upper end 22*a*, which is shaped as a square frame. When the carriage 12 is moved to the cleaning position, the upper end 22*a* of the cap 22 is moved toward the recording head 16 and then pressed against the nozzle forming surface 16*a*. The sealed space is thus defined between the recording head 16 and the cap 22.

Figure 5:
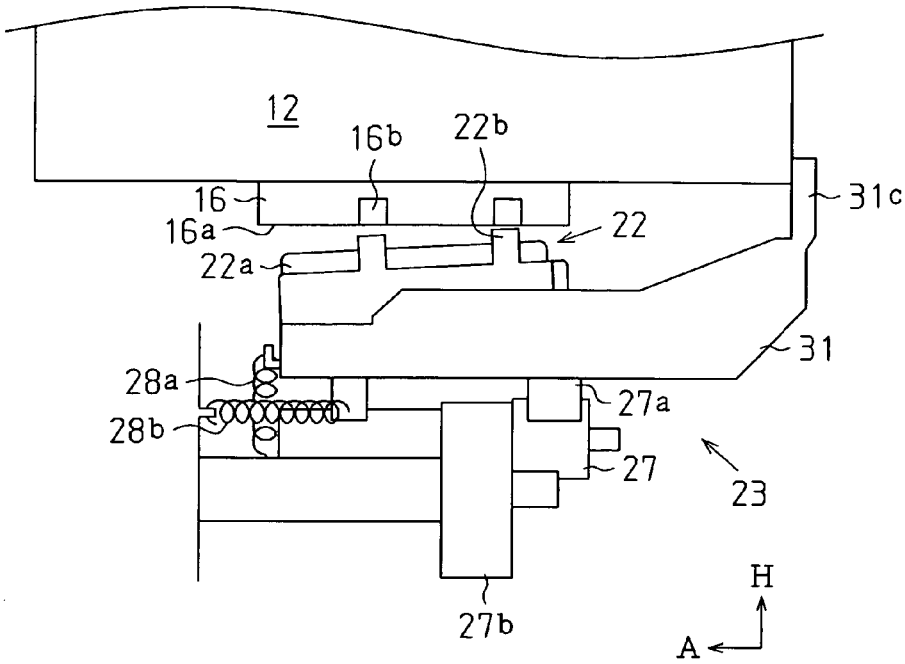
FIG. 5 is a side explaining the operation of certain members of the main part of the device of FIG. 1.
Figure 6:
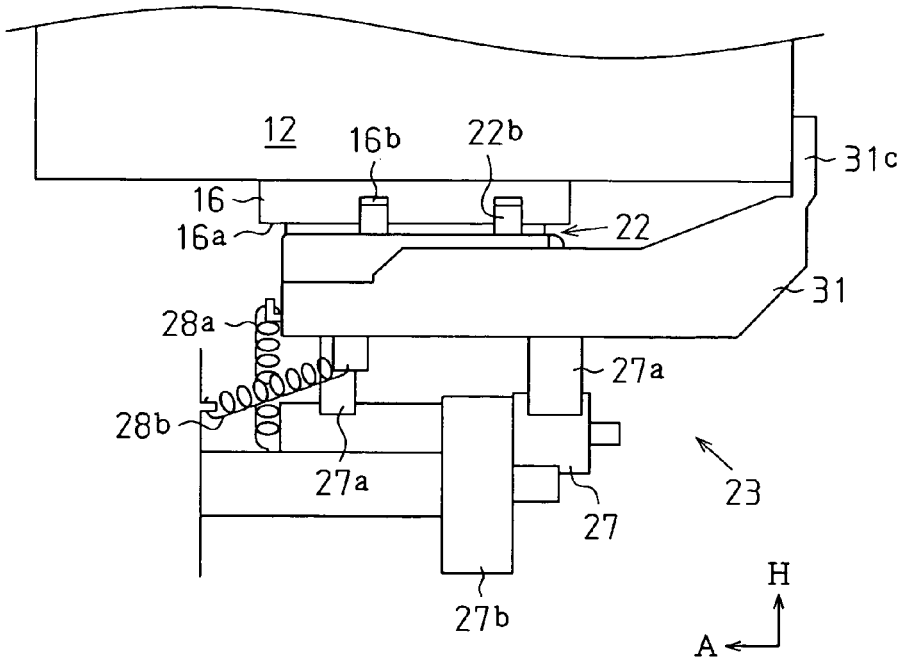
FIG. 6 is another side view explaining the operation of the certain members of the main part of the device of FIG. 1.

As illustrated in FIGS. 5 and 6, the cap mechanism 23 includes a rotary cam 27 with a plurality of (in this embodiment, two) cam portions 27*a*, a power transmitting gear 27*b*, and a slider 31 formed of resin. The slider 31 contacts the cam portions 27*a*. The slider 31 is urged downward by a spring 28*a* and sideward by a spring 28*b*. The slider 31 holds the cap 22. When the cam portions 27*a* are rotated by the drive force of the power transmitting gear 27*b*, the slider 31 is lifted toward the recording head 16 along a direction H as viewed in the drawings, against the resilient forces of the springs 28*a*, 28*b*. The upper end 22*a* of the cap 22 is then placed in tight contact with the nozzle forming surface 16*a* of the recording head 16.

In the first embodiment, the rotary cam 27, the power transmitting gear 27*b*, and the springs 28*a*, 28*b* form a cap moving mechanism. The recording head 16 is reciprocated along a direction in which the nozzle forming surface 16*a*, which is in tight contact with the cap 22, is extended. In contrast, the cap 22 is lifted or lowered along the direction H such that the cap 22 is moved toward or away from the nozzle forming surface 16*a*.

As shown in FIGS. 2 to 4, a sponge sheet 29 is fixed to the bottom of the cap 22. The sponge sheet 29 prevents the ink drawn from the nozzles of the recording head 16 from being splashed. A wiper 30 is arranged at a position opposing an end of the platen 17. When the recording head 16 moves away from the cleaning position (in a leftward direction in FIG. 2), the wiper 30 wipes and cleans the nozzle forming surface 16*a* of the recording head 16.

Figure 7:
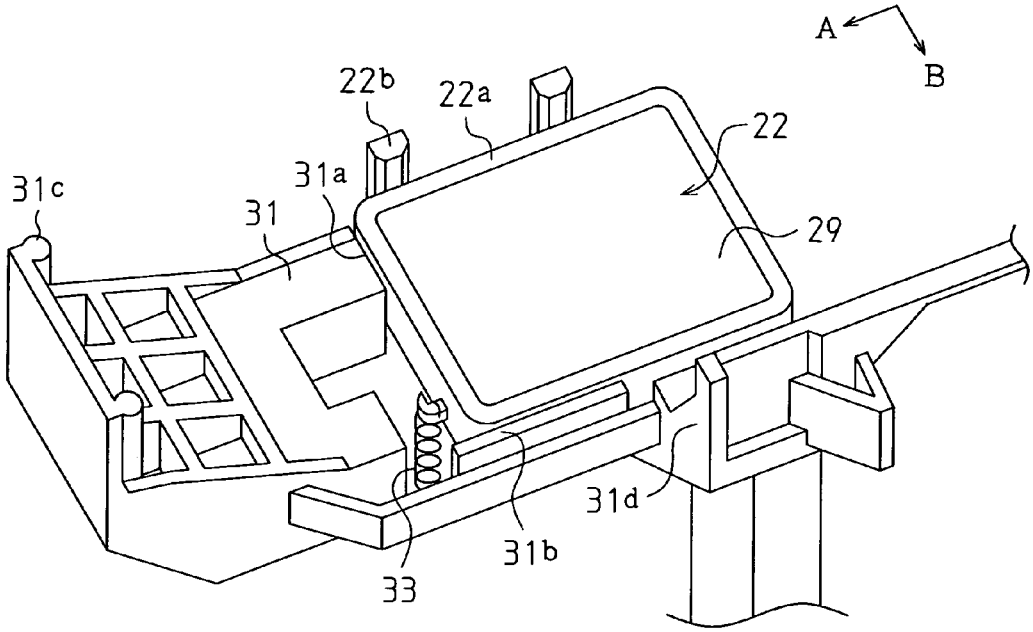
FIG. 7 is a perspective view showing the members of the main part of the device of FIG. 1.
Figure 8:
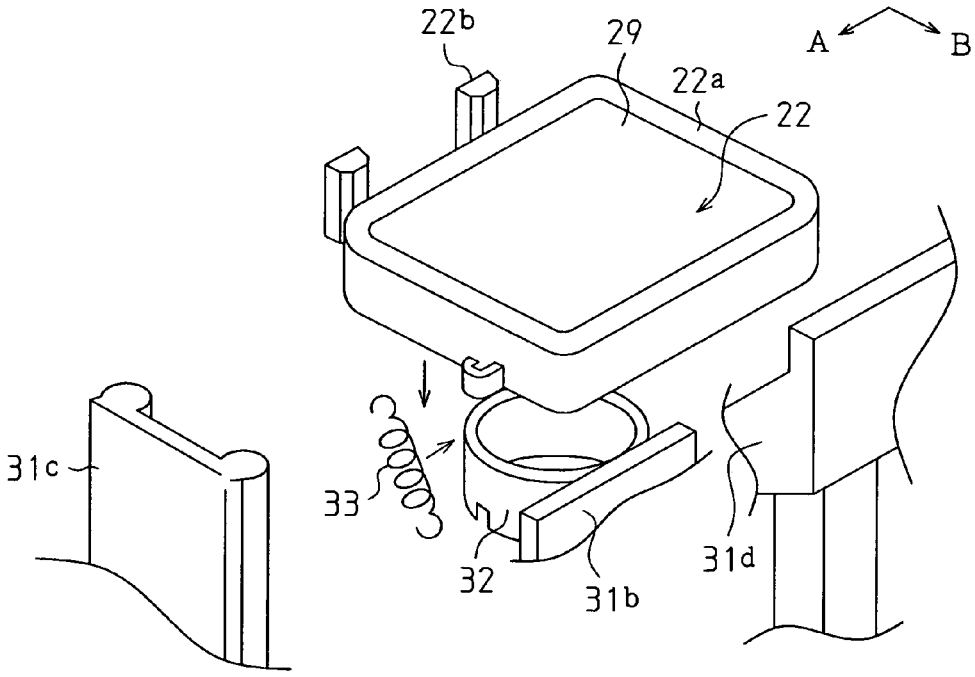
FIG. 8 is an exploded perspective view showing the members of the main part of the device of FIG. 1.

With reference to FIGS. 7 and 8, an annular compression spring 32 is deployed between the slider 31 and the cap 22. The compression spring 32 supports the cap 22 and urges the bottom side of the cap 22 toward the nozzle forming surface 16*a*, enabling the upper end 22*a* of the cap 22 to remain in tight contact with the nozzle forming surface 16*a* of the recording head 16.

The slider 31 supports the cap 22 such that the cap 22 is slidable in the main scanning direction (the extending direction of the nozzle forming surface 16*a*). The slider 31 includes a first cap stopper 31*a* and a second cap stopper 31*b*. Each of the stoppers 31*a*, 31*b* opposes an associated one of two perpendicular side surfaces of the cap 22. A spring 33, which serves an urging member, is arranged in the vicinity of the position at which the hypothetical plane along which the first cap stopper 31*a* is extended crosses the hypothetical plane along which the second cap stopper 31*b* is extended. The spring 33 urges the cap 22 toward the first and second cap stoppers 31*a*, 31*b*.

The first cap stopper 31*a* is engaged with the associated side of the cap 22, which is urged by the spring 33 to slide in the direction indicated by arrow A in the drawings (the direction in which the recording head 16 moves to the cleaning position). The position of the side of the cap 22 is thus determined. The second cap stopper 31*b* is engaged with the associated side of the cap 22, which is urged by the spring 33 to slide in the direction indicated by arrow B in the drawings, determining the position of the side of the cap 22.

The cap 22 is supported in a manner slidable in a range permitted by the slider 31 with respect to the main scanning direction. The cap 22 is positioned at a location at which the cap 22 is held in tight contact with the nozzle forming surface 16*a* of the recording head 16, as engaged with the cap stoppers 31*a*, 31*b*.

In the first embodiment, the slider 31, including the first and second cap stoppers 31*a*, 31*b*, the compression spring 32 and the spring 33, forms a cap holding mechanism. The first and second cap stoppers 31*a*, 31*b* also function as positioning portions. As illustrated in FIGS. 7 and 8, a pair of engaging pieces 22*b* are located at a position opposed to the second cap stopper 31*b*. The engaging pieces 22*b* are engaged with a side recess 16*b* of the recording head 16 and guide the recording head 16 to an optimal position at which the recording head 16 is placed in tight contact with the cap 22.

A pair of resin head stoppers 31*c*, 31*d* are formed integrally with the slider 31. The head stoppers 31*c*, 31*d* are located at positions adjacent to the first and second cap stoppers 31*a*, 31*b* and outward with respect to the cap stoppers 31*a*, 31*b*, respectively. The first head stopper 31*c* is located outward with respect to a direction indicated by arrow A, as compared to the first cap stopper 31*a*. The second head stopper 31*d* is located outward with respect to a direction indicated by arrow B, as compared to the second cap stopper 31*b*. The head stoppers 31*c*, 31*d* extend upward with respect to the upper end 22*a* of the cap 22.

Figure 9:
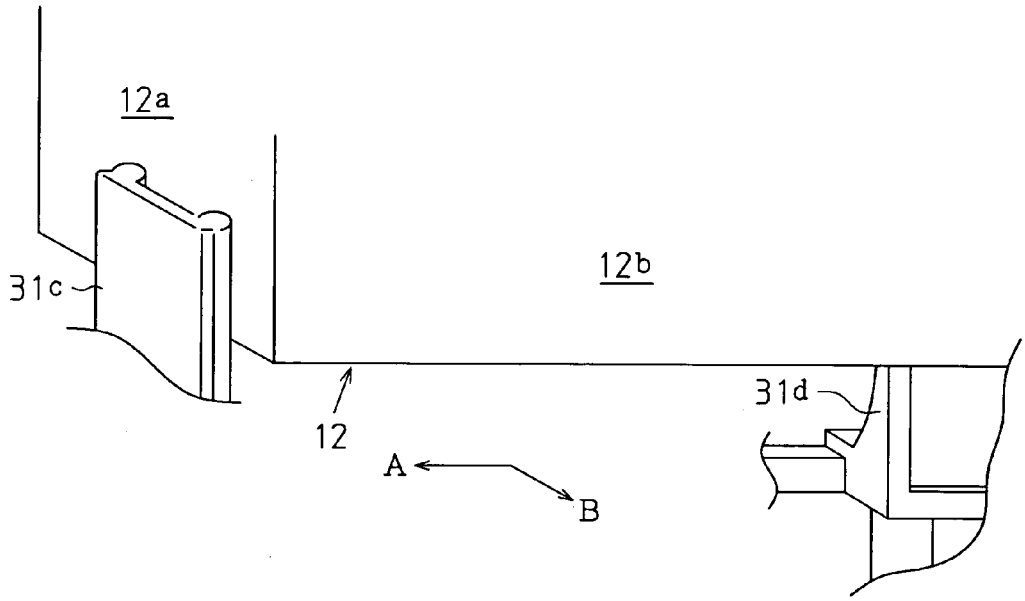
FIG. 9 is a perspective view showing the engagement between certain members of the main part of the device of FIG. 1.
Figure 10:
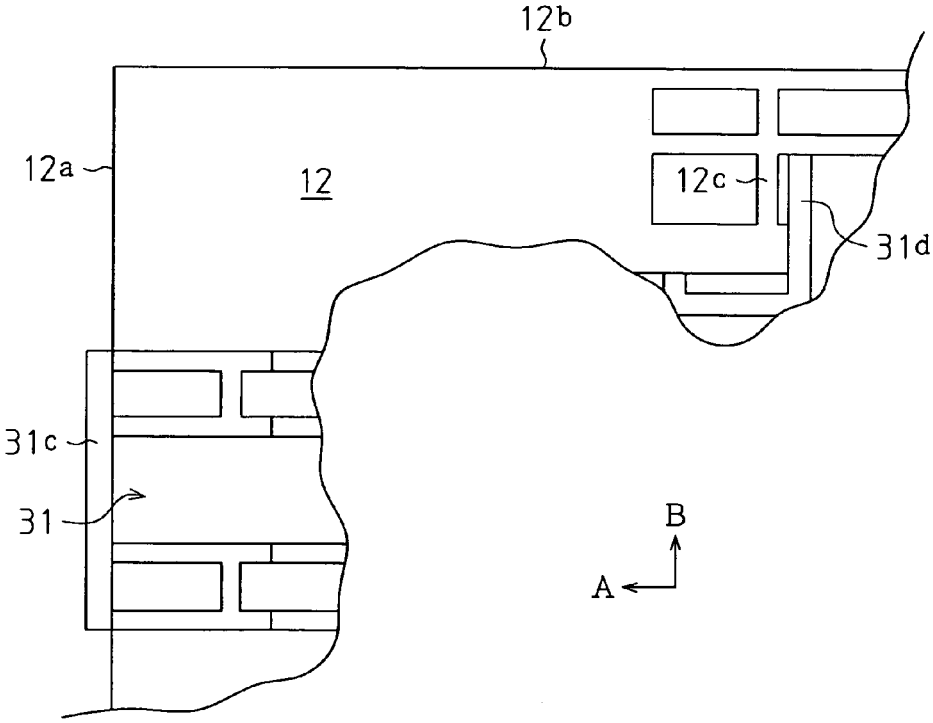
FIG. 10 is a bottom view showing the engagement between the certain members of the main part of the device of FIG. 1.

With reference to FIGS. 9 and 10, when the carriage 12 is located at the cleaning position, the first head stopper 31*c* faces a side 12*a* of the carriage 12 in the direction indicated by arrow A in the drawings. The second head stopper 31*d* extends inward from a side 12*b* of the carriage 12 with respect to the direction indicated by arrow B in the drawings. The second head stopper 31*d* projects into a rib 12*c*, which is formed in a bottom side of the carriage 12, and contacts a side of the rib 12*c*.

When the slider 31 is held in a lifted state, the cap 22, which is positioned by the cap stoppers 31*a*, 31*b*, is placed in tight contact with the nozzle forming surface 16*a*. This arrangement defines a sealed space, which protects the recording head 16 from factors such as the ambient air. It also makes it possible to reliably execute a cleaning operation that includes, for example, drawing ink from the nozzles.

As the cap 22 approaches the recording head 16, the first and second head stoppers 31*c*, 31*d* are held in a state engaged with the side 12*a* and the rib 12*c* of the carriage 12, respectively. The recording head 16 is thus easily positioned at a standby position at which the recording head 16 is maintained when stopped.

Figure 11:
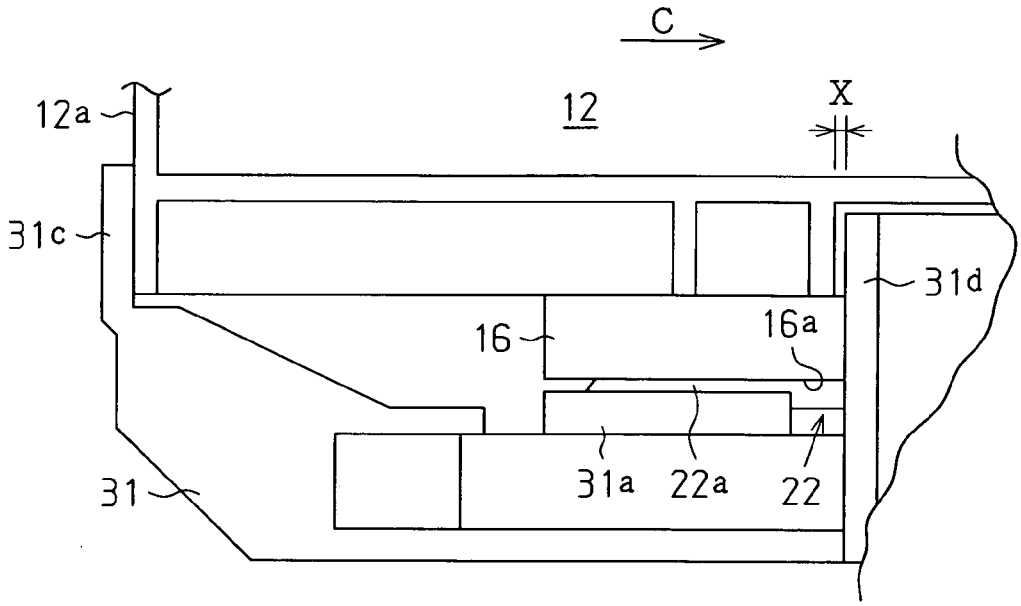
FIG. 11 is a side view, explaining the operation of certain members of the main part of the device of FIG. 1.
Figure 12:
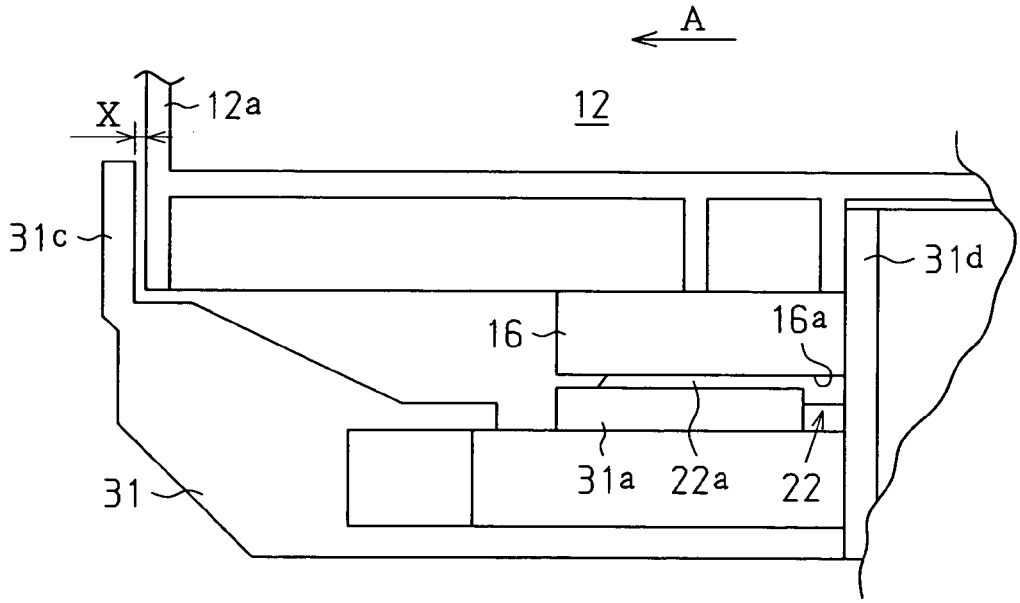
FIG. 12 is another side view, explaining the operation of the certain members of the main part of the device of FIG. 1.

More specifically, as illustrated in FIGS. 11 and 12, a clearance X is created between the side 12*a* and the rib 12*c* of the carriage 12, which are associated respectively with the first head stopper 31*c* and the second head stopper 31*d*. The recording head 16 is permitted to reciprocate in a range defined by the clearance X. The range defined by the clearance X corresponds to a range in which the cap 22 is permitted to slide when held in tight contact with the nozzle forming surface 16*a*. In the range defined by the clearance X, the cap 22 is allowed to follow the movement of the recording head 16 while maintaining the tight contact with the nozzle forming surface 16*a*.

Figure 13:
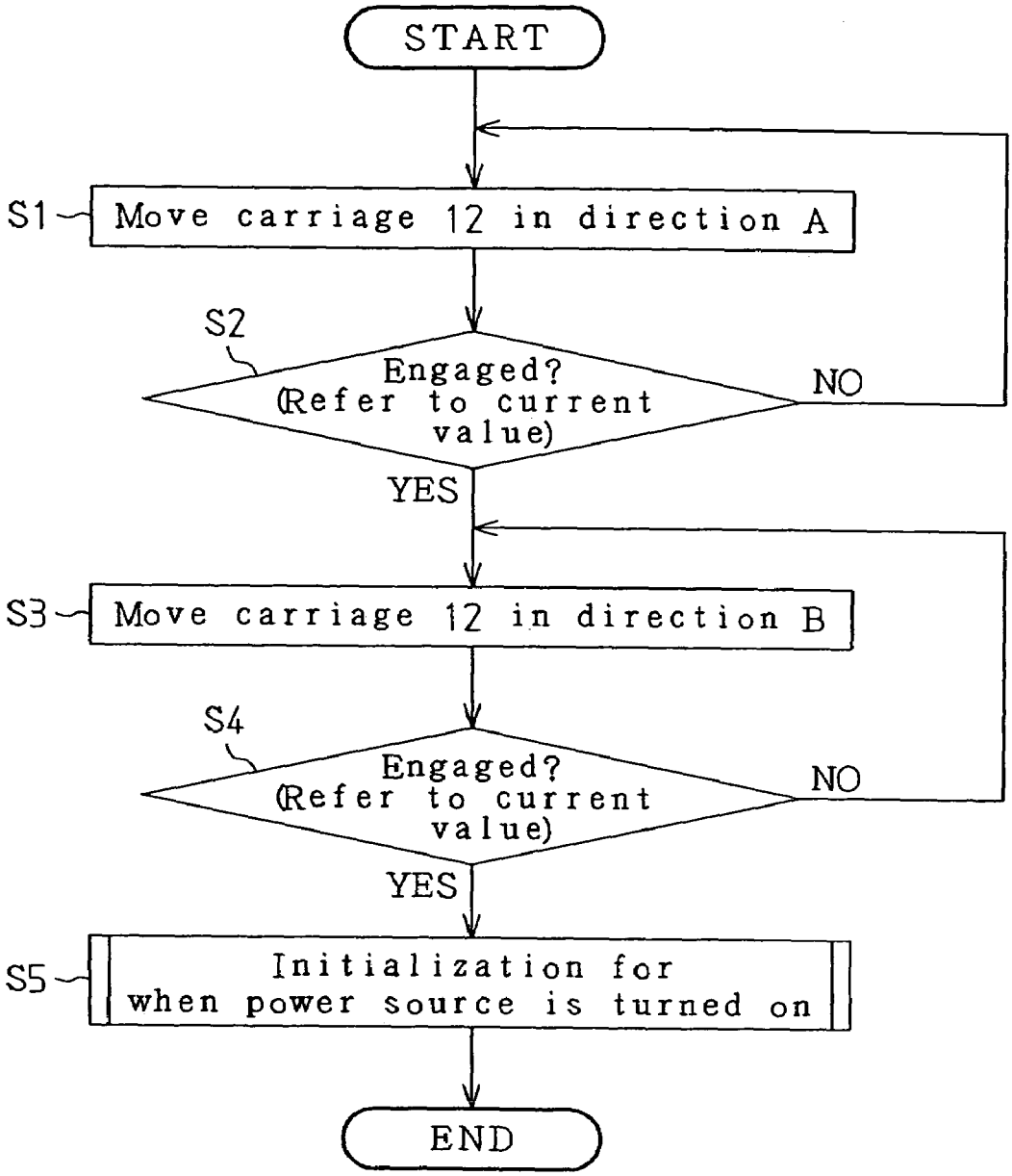
FIG. 13 is a flowchart explaining the operation of the main mechanism of the device of FIG. 1.

For example, when the power source is turned on, the inkjet recording device 10 starts to execute a process for detecting the position of the recording head 16 in accordance with the flowchart of FIG. 13. During the detection of the position of the recording head 16, it is unnecessary to separate the cap 22 from the recording head 16.

More specifically, when the power source is turned on, the inkjet recording device 10 operates to rotate the motor 14 in a direction (indicated by arrow C in FIG. 11) in which the recording head 16 is moved from the cleaning position toward a recording sheet P (Step S1). When the outcome of step S2 is YES, or when it is determined that the carriage 12 is engaged with a certain member based on the value of the current supplied to the motor 14, the motor 14 is driven to rotate in the reverse direction (step S3). In this state, since the carriage 12 is engaged with the second head stopper 31*d*, the carriage 12 is permitted to move only in a range corresponding to the clearance X. The cap 22 is thus maintained in tight contact with the nozzle forming surface 16*a* of the recording head 16.

The reverse rotation of the motor 14 moves the recording head 16 in a direction (indicated by arrow A in FIG. 12) in which the recording head 16 is returned to the cleaning position. When the outcome of step S4 is YES, or when it is determined that the carriage 12 is engaged with a certain member based on the value of the current supplied to the motor 14, an initializing process is executed (step S5). More specifically, according to the initializing process, the inkjet recording device 10 determines the position at which the carriage 12 is engaged with the certain member as a home position (the standby position) of the recording head 16 (the carriage 12). In this state, since the carriage 12 is engaged with the first head stopper 31*c*, the carriage 12 is permitted to move only in the range corresponding to the clearance X. Therefore, with the cap 22 held in tight contact with the nozzle forming surface 16*a* of the recording head 16, the recording head 16 is allowed to proceed to a standby state, which is continued until printing data is received.

In the first embodiment, the cap 22 is allowed to slide in accordance with the moving direction of the recording head 16. Further, since the moving range of the recording head 16 is limited to a relatively small range corresponding to the clearance X, the nozzle forming surface 16*a* of the recording head 16 is reliably maintained in the sealed state. This structure suppresses unnecessary separation of the cap 22 from the recording head 16. It is thus possible to suppress dryness or deterioration of ink, which is caused by the exposure of the nozzle recording surface 16*a* of the recording head 16 to the ambient air. As a result, the images are formed with the ink of an improved quality.

The stoppers 31*a* to 31*d* are formed integrally with the slider 31. The mechanism for either lifting or lowering the slider 31 is easily configured by the rotary cam 27, the power transmitting gear 27*b*, and the springs 28*a*, 28*b*. Further, the cap 22 is positioned easily by the spring 33. This structure lowers the production costs.

A second embodiment of the present invention will hereafter be described with reference to FIGS. 14 to 24. The description focuses on the points different from the first embodiment. Same or like reference numerals are given to parts of the second embodiment that are the same or like corresponding parts of the first embodiment. The description thereof will be omitted.

Figure 14:
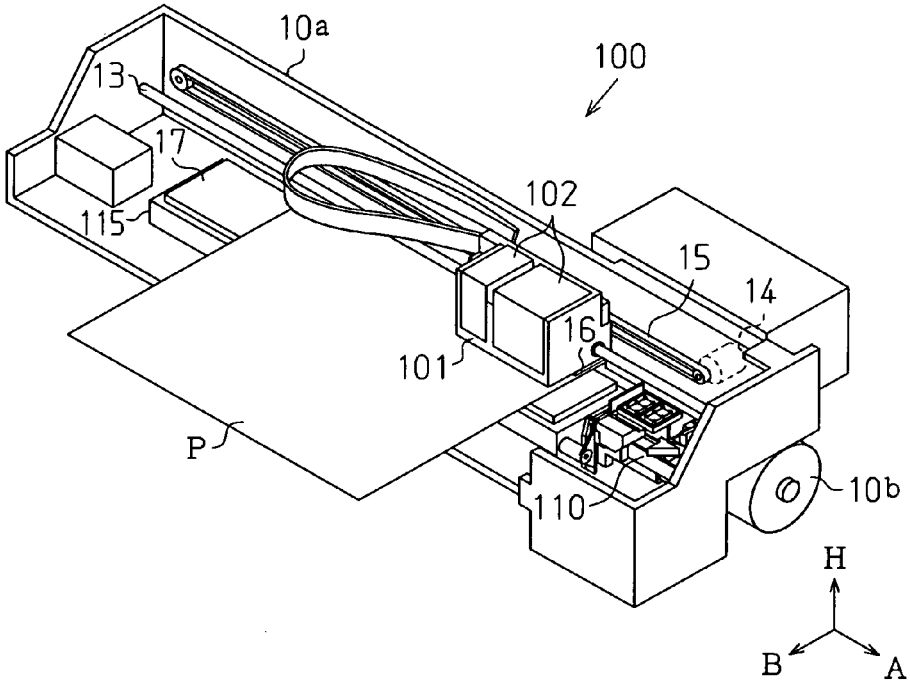
FIG. 14 is a perspective view showing an inkjet recording device according to a second embodiment of the present invention.

As shown in FIG. 14, an inkjet recording device 100, which serves as a liquid injection apparatus, includes a carriage 101. An ink cartridge 102 serving as a liquid retaining portion is separably received in the carriage 101. The ink cartridge 102 has a plurality of reservoir chambers. Each reservoir chamber reserves ink (pigment or reactant ink, for example) as liquid. The inkjet recording device 100 of the second embodiment is an on-carriage type. The ink in each of the reservoir chambers of the ink cartridges 102 is supplied to an associated one of the nozzles of the recording head 16. Therefore, when the ink cartridge 102 is installed in the carriage 101, the ink flows from the ink cartridge 102 to the recording head 16. In the second embodiment, a main scanning direction +A is defined as a rightward direction, and another main scanning direction −A is defined as a leftward direction. A direction +B is defined as a forward direction, and a direction −B is defined as a rearward direction. A height direction +H is defined as an upward direction, and another height direction −H is defined as a downward direction.

In the second embodiment, a zone in which the carriage 101 is reciprocated for injecting ink to the recording sheet P for printing an image corresponds to an injecting zone. The inkjet recording device 100 has a non-printing zone in which the nozzles are sealed when printing is suspended. A maintenance unit 110 is provided in the non-printing zone. The maintenance unit 110 performs maintenance work for the recording head 16 as needed, for maintaining the injecting performance of each nozzle in an optimal state.

Figure 15:
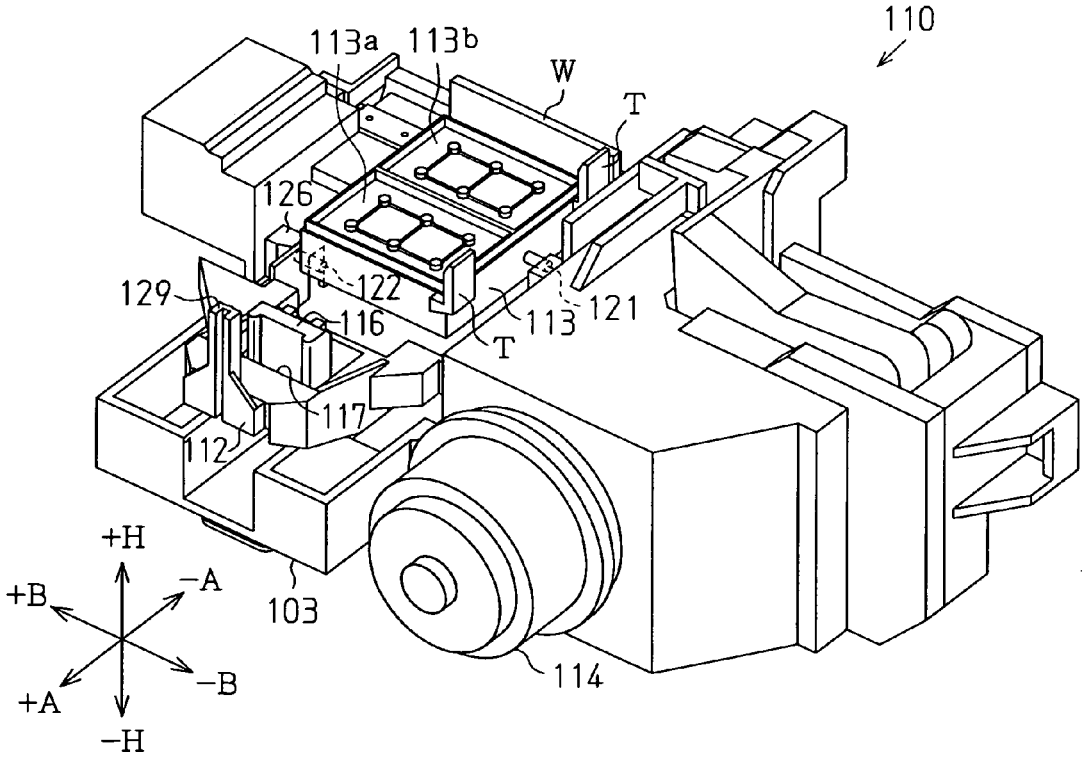
FIG. 15 is a perspective view schematically explaining a maintenance unit provided in the device of FIG. 14.

With reference to FIG. 15, the maintenance unit 110 includes a casing main body 103. A slider 112 is secured to the casing main body 103 by a first spring member SP1 serving as a first urging member (FIG. 16(*a*) or 17(*a*)). In this state, the slider 112 is permitted to reciprocate along the main scanning directions. A cap 113, shaped as a rectangular parallelopiped, is formed in the slider 112 for sealing the nozzles of the recording head 16. In order to seal each nozzle of the recording head 16, the maintenance unit 110 operates to move the cap 113 horizontally in a main scanning direction to a position immediately below the recording head 16 by means of a drive mechanism, which will later be explained. Further, the maintenance unit 110 either lifts or lowers the cap 113 along the height directions to place the cap 113 in tight contact with the recording head 16. A contact portion 129 is formed in the slider 112 and extends along the height directions.

The recess formed by the cap 113 is divided into two sections. Each of the sections receives an associated one of absorbers 113*a*, 113*b*. A non-illustrated bottom of the cap 113 is connected with a discharged ink reservoir 115 through two tubes (not illustrated), each of which is connected with an associated one of the absorbers 113*a*, 113*b*, and a suction pump 114. The discharged ink reservoir 115 is formed below the platen 17, as shown in FIG. 14. The interior of the discharged ink reservoir 115 is divided into two sections. Each of the sections is connected to an associated one of the absorbers 113*a*, 113*b*. The suction pump 114 operates such that negative pressure is applied to the recess of the cap 113 through the tubes.

If the suction pump 114 is actuated while a non-illustrated air valve maintains the recess of the cap 113 in a non-open state with the nozzles of the recording head 16 sealed by the cap 113, the ink is drawn from the nozzles of the recording head 16. The ink is introduced through the tubes and then discharged to the discharged ink reservoir 115. Further, if the suction pump 114 is actuated with the recess of the cap 113 maintained in an open state by the air valve and without sealing the nozzles of the recording head 16 by the cap 113, the ink is drawn from the cap 113 through the tubes and then discharged to the discharged ink reservoir 115.

Therefore, in this structure, if the ink cartridge 102 reserves pigment ink and reactant ink, the two types of ink are separately absorbed by the absorbers 113*a*, 113*b* and separately discharged to the discharged ink reservoir 115.

As illustrated in FIG. 15, the maintenance unit 110 is provided with a wiper W for wiping ink from the nozzle forming surface 16*a* of the recording head 16. It is possible to accommodate the wiper W in the casing main body 103 by means of a non-illustrated drive mechanism.

The configuration of the maintenance unit 110 will now be explained with reference to FIGS. 16(*a*) to 21.

As shown in FIGS. 16(*a*) and 16(*b*), the maintenance unit 110 has a slider guide 116 formed in the casing main body 103 for guiding the slider 112. The slider guide 116 is inserted in an insert recess 117 of the slider 112. A first support bar 118 projects toward the slider guide 116 (in a rightward direction in FIG. 16(*a*)) in the insert recess 117. A first support groove 119 extends through the slider guide 116 for receiving the first support bar 118. The first support groove 119 permits the first support bar 118 to move in the main scanning direction. Further, the first support groove 119 is formed as an elongated hole extending in a height direction for permitting the first support bar 118 to move in the height direction. When the first support bar 118 contacts the upper wall of the first support groove 119, the first support bar 118 is restricted from moving further upward.

As aforementioned, the first spring member SP1 secures the slider 112 to the casing main body 103. The slider 112 is thus urged in the leftward direction (−A) with respect to the casing main body 103. Therefore, when the slider 112 is free from other force, a wall of the insert recess 117 is held in a state abutted by the right side wall of the slider guide 116 in the casing main body 103 (a reference position), as illustrated in FIG. 16(*a*).

Figure 18:
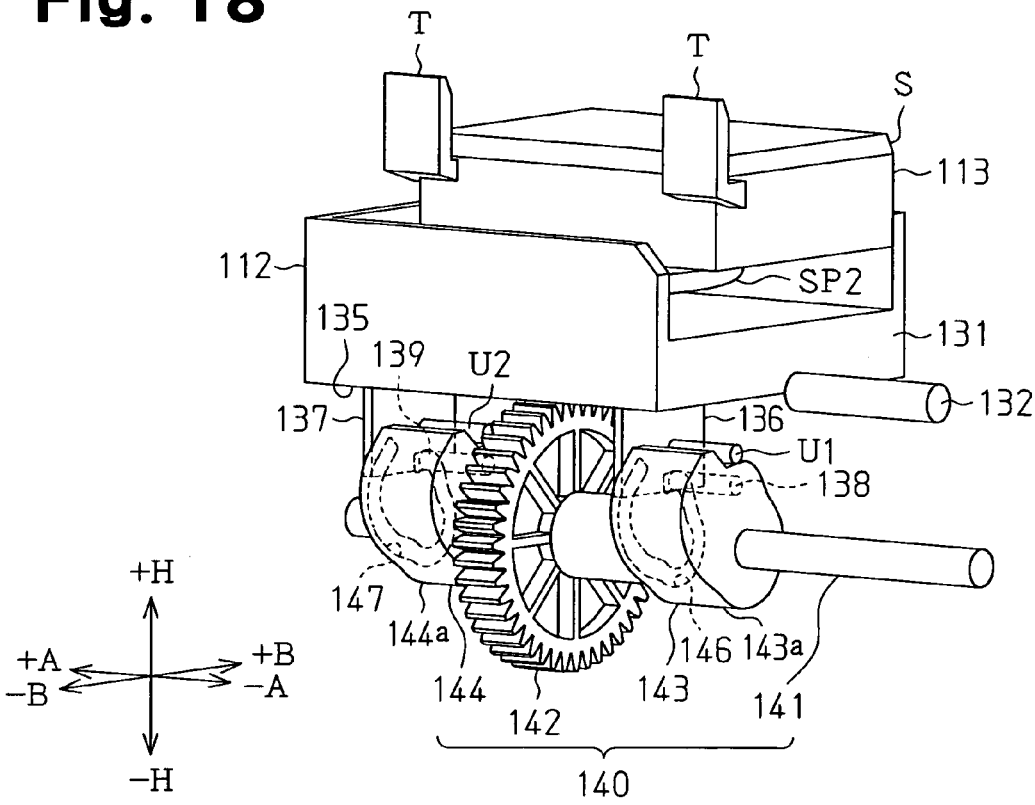
FIG. 18 is a perspective view explaining the configuration of a slider drive mechanism provided in the device of FIG. 14.

With reference to FIG. 18, the cap 113 is secured to the slider 112 by a second spring member SP2, which serves as a second urging member. As shown in FIGS. 16(*a*) and 17(*a*), the cap 113 includes a contact portion S and an extension T. The contact portion S is flexible and is placed in tight contact with the recording head 16. The extension T serves as a support member contacting the recording head 16. Further, the cap 113 includes a second support bar 120 projecting in the forward direction (+B), a third support bar 121 projecting in the rearward direction (−B), and a positioning bar 122 serving as a positioning member projecting in the forward direction (+B).

As illustrated in FIGS. 16(*a*) and 17(*a*), the slider 112 includes a second support groove 123 corresponding to the second support bar 120, a third support groove 124 corresponding to the third support bar 121, and a guide groove 125 serving as a guide member corresponding to the positioning bar 122. The second support groove 123, the third support groove 124, and the guide groove 125 support the second support bar 120, the third support bar 121, and the positioning bar 122, respectively. The support grooves 123, 124 and the guide groove 125 each extend in a height direction. Each of the support bars 120, 121 and the positioning bar 122 is allowed to move in the height direction but prohibited from moving in the main scanning directions in the associated one of the support grooves 123, 124 and the guide groove 125. The contact between the upper wall of the associated groove 123, 124, 125 and each bar 120, 121, 122 restricts the bar 120, 121, 122 from moving further upward (in direction +H). The depths of the support grooves 123, 124 and the guide grooves 125 are selected such that each bar 120, 121, 122 does not separate from the associated groove 123, 124, 125 when the cap is moved in the forward direction (+B) or the rearward direction (−B).

The cap 113 is urged in the upward direction (+H) by the second spring member SP2. Meanwhile, the upward movement of the cap 113 (in direction +H) is limited by the second and third support bars 120, 121 and the positioning bar 122. Thus, normally, the cap 113 is located at a position most spaced from the slider 112 in the upward direction (+H). The cap 113 is moved downward (in direction −H) if urged downward (in direction −H).

With reference to FIGS. 16(*a*) and 17(*a*), a third spring member SP3 connects the slider 112 and the right wall of the cap 113. The third spring member SP3 urges the cap 113 in a rightward and forward direction (a combined direction of +A and +B).

As shown in FIGS. 16(*b*) and 17(*b*), the casing main body 103 includes a projection 126 shaped substantially as a trapezoid, which serves as a guide portion. The projection 126 projects from the casing main body 103 in the rearward direction (−B) and opposes the positioning bar 122 of the cap 113.

With reference to FIG. 16(*a*), the positioning bar 122 contacts an end surface 127 of the projection 126, when the slider 112 is located at the reference position. In this state, the cap 113 is supported by the projection 126 through the positioning bar 122 and is restricted from the movement in the forward direction (+B).

Further, if the slider 112 is moved rightward (in direction +A) from the reference position, the cap 113 secured to the slider 112 is urged by the third spring member SP3 in the forward direction (+B). This moves the positioning bar 122 along a slope 128 of the projection 126 in the rightward and forward direction (the combined direction of +A and +B). As shown in FIG. 17(*a*), the positioning bar 122 is supported by the slope 128 of the projection 126. At this stage, the cap 113 is held in a state stopped as slightly shifted forward (in direction +B) (a set position), as compared to the state of FIG. 16(*a*).

For example, if the recording head 16 contacts the contact portion 129 of the slider 112 to urge the slider 112 rightward (in direction +A), the slider 112 moves in the rightward direction (+A). In accordance with the movement of the slider 112, the cap 113 is moved to the set position. The extension T of the cap 113 is thus moved forward (in direction +B) and contacts the recording head 16. The set position corresponds to the position at which the cap 113 directly opposes the nozzles of the recording head 16. The reference position corresponds to the position at which the cap 113 is retreated from the path of the recording head 16 along the main scanning direction.

The dimension of the guide groove 125 of the slider 112 is approximately 1.2 times as large as the diameter of the positioning bar 122 of the cap 113. It is thus possible to suppress deterioration of the positioning bar 122, which is otherwise caused by the contact between the positioning bar 122 and the wall of the guide groove 125. It is also possible to avoid friction between the positioning bar 122 and the wall of the guide groove 125, which hampers the movement of the cap 113 in the forward or rearward directions.

Next, the configuration of the drive mechanism for the slider 112 will be explained with reference to FIG. 18 to 22.

As shown in FIG. 18, a shaft 132 projects rightward (in direction −A) from a lower section of a side 131 of the slider 112. The shaft 132 is inserted in a guide groove 134 serving as a guide member, which is formed in a side 133 of the casing main body 103 and extends in the height direction, with reference to FIG. 22. The length of the shaft 132 is sufficient for remaining in the guide groove 134 when the slider 112 is moved in a main scanning direction (see FIG. 17(*a*)).

As illustrated in FIG. 18, two plate portions 136, 137 extend downward (in direction −H) from a bottom 135 of the slider 112. The plate portion 36 includes a slide shaft 138 and a contact shaft U1, while the plate portion 37 includes a slide shaft 139 and a contact shaft U2. The slide shafts 138, 139 and the contact shafts U1, 132 project in the rightward direction (−A)

A cam mechanism 140 is accommodated in the casing main body 103 and serves as a drive mechanism located below the slider 112. The cam mechanism 140 includes a shaft 141, a gear 142, and two cam portions 143, 144. The gear 142 is secured to the shaft 141. The cam portions 143, 144 are also secured to the shaft 141 with the gear 142 located between the cam portions 143, 144. When the gear 142 is driven to rotate, the cam portions 143, 144 are rotated in the same direction.

One of the opposing ends of the shaft 141 is fitted in a support hole 145 (FIG. 22) formed in the side 133 of the case 103. The other is fitted in a support hole (not illustrated) formed in the casing main body 103. The shaft 141 is thus rotationally supported by the casing main body 103. This structure enables the cam mechanism 140 to rotate around the shaft 141. As shown in FIG. 18, the slide shaft 138 of the plate portion 136 is received in a slide groove 146 formed in the cam portion 143. In the same manner, the slide shaft 139 of the plate portion 137 is received in a slide groove 147 formed in the cam portion 144. The cam mechanism 140 is thus secured to the slider 112. The contact shaft U1 and the contact shaft U2 slidably contact a side 143*a* of the cam portion 143 and a side 144*a* of the cam portion 144, respectively.

When the cam portions 143, 144 are rotated, each of the slide shafts 138, 139 slides along the associated one of the slide grooves 146, 147. In this state, each of the contact shafts U1, U2 slidably contacts and is supported by the associated one of the sides 143*a*, 144*a* of the cam portions 143, 144. In accordance with the rotation of the cam portions 143, 144, the interval between the shaft 141 and each contact shaft U1, U2 is shortened or lengthened. Further, in accordance with the position of the shaft 141 and the position of each shaft U1, U2 relative with each other, the shaft 132 of the slider 112 is guided along the guide groove 134. This structure enables the slider 112 to move in the height directions (+H and −H) with respect to the casing main body 103.

Figure 19:
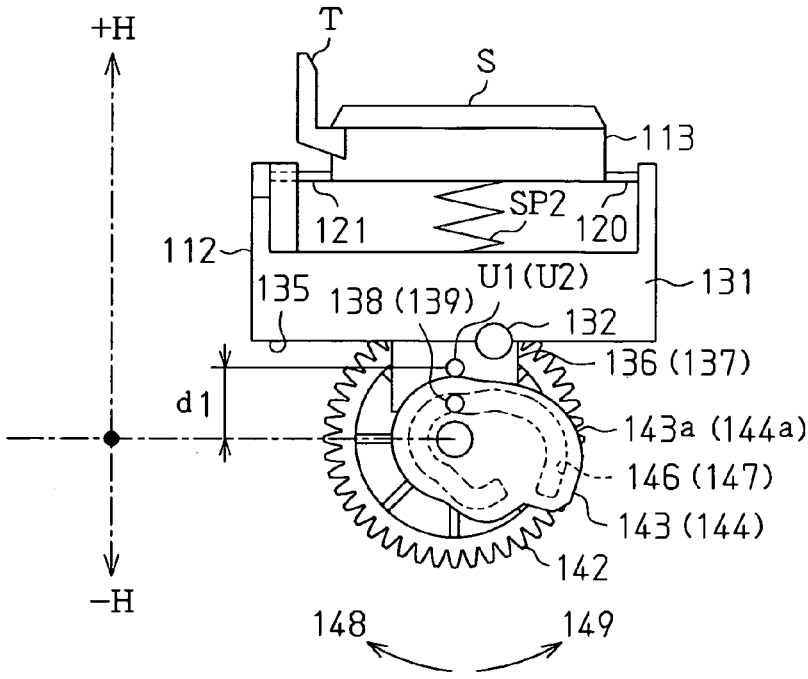
FIG. 19 is a side view explaining the configuration of the slider drive mechanism of FIG. 18.

A non-illustrated drive mechanism transmits the drive force of a non-illustrated drive motor, which is capable of rotating in positive or negative directions, to the gear 142 of the cam mechanism 140. For example, if each of the slide grooves 146, 147 of the cam portions 143, 144 is located relative to the associated one of the slide shafts 138, 139 as indicated in FIG. 19 (the relative distance between the shaft 141 and each contact shaft U1, U2 is d1), the rotation of the drive motor in the positive direction rotates the gear 142 in a direction indicated by an arrow 148 (clockwise), in accordance with the drive force of the motor. Thus, each slide shaft 138, 139 slides in the associated slide groove 146, 147 to the position of FIG. 20. Each of the contact shafts U1, U2 slides along the associated one of the sides 143*a*, 144*a* of the cam portions 143, 144. In this state, the distance between the shaft 141 and each contact shaft U1, U2 is d2.

In contrast, if the drive motor is rotated in the negative direction with each slide groove 146, 147 located relative to the associated slide shaft 138, 139 as indicated in FIG. 19, the gear 142 is rotated in a direction indicated by an arrow 149 (counterclockwise), in accordance with the drive force of the motor. Thus, each slide shaft 138, 139 slides in the associated slide groove 146, 147 to the position of FIG. 21. Each contact shaft U1, U2 slides along the associated side 143*a*, 144*a*. In this state, the distance between the shaft 141 and each contact shaft U1, U2 is d3.

The distance d1 is smaller than the distance d2 and the distance d2 is smaller than the distance d3: d1<d2<23. Therefore, in the second embodiment, as held in the state of FIG. 21 (corresponding to the distance d3), the slider 112 is lifted maximally upward (in direction +H) with respect to the casing main body 103. In contrast, as held in the state of FIG. 19 (corresponding to the distance d1), the slider 112 is lowered maximally downward (in direction −H) with respect to the casing main body 103. Further, as held in the state of FIG. 20 (corresponding to the distance d2), the slider 112 is located higher than the position of FIG. 19 and lower than the position of FIG. 21.

Figure 20:
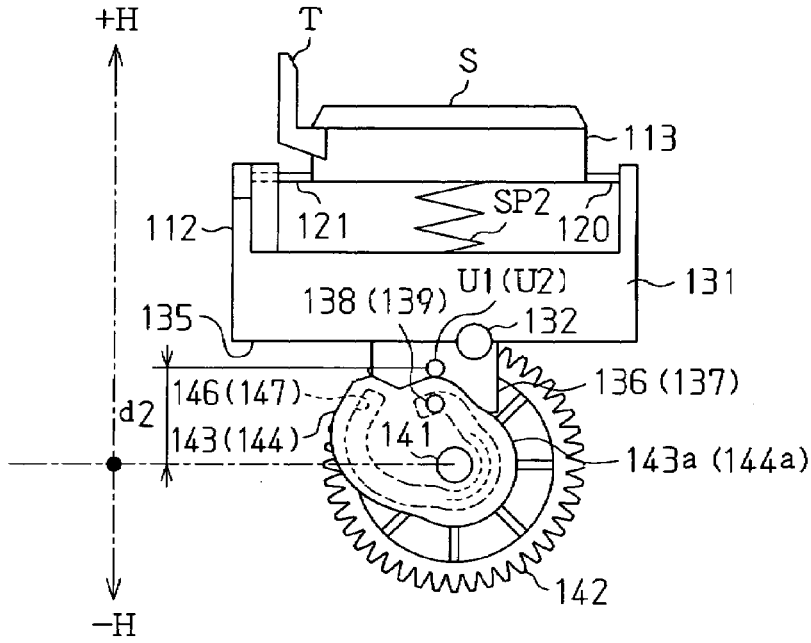
FIG. 20 is another side view explaining the configuration of the slider drive mechanism of FIG. 18.
Figure 21:
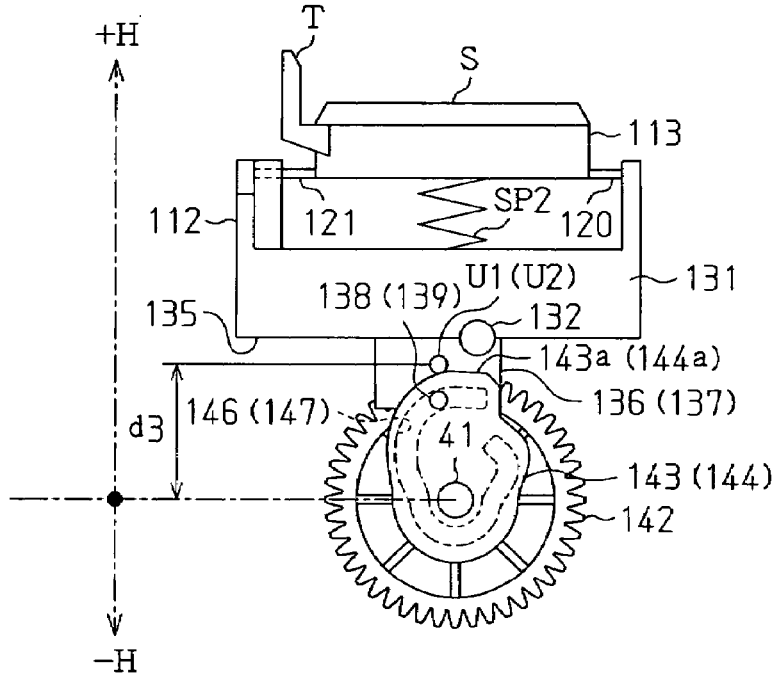
FIG. 21 is another side view explaining the configuration of the slider drive mechanism of FIG. 18.

In the second embodiment, the state of FIG. 19 is defined as a standby state, the state of FIG. 20 is defined as a flushing state, and the state of the 21 is defined as a capping state. The drive motor reverses the rotating direction based on a signal of a non-illustrated control circuit formed in the inkjet recording device 100. It is possible to maintain the slider 112 in the standby, flushing, or capping state by stopping the drive motor.

When the slider 112 is held in the standby state, the wiper W is received in the casing main body 103. When the slider 112 switches to the flushing state, the wiper W is moved out of the casing main body 103 and sent to a position at which the slider 112 is allowed to contact the recording head 16.

Figure 22:
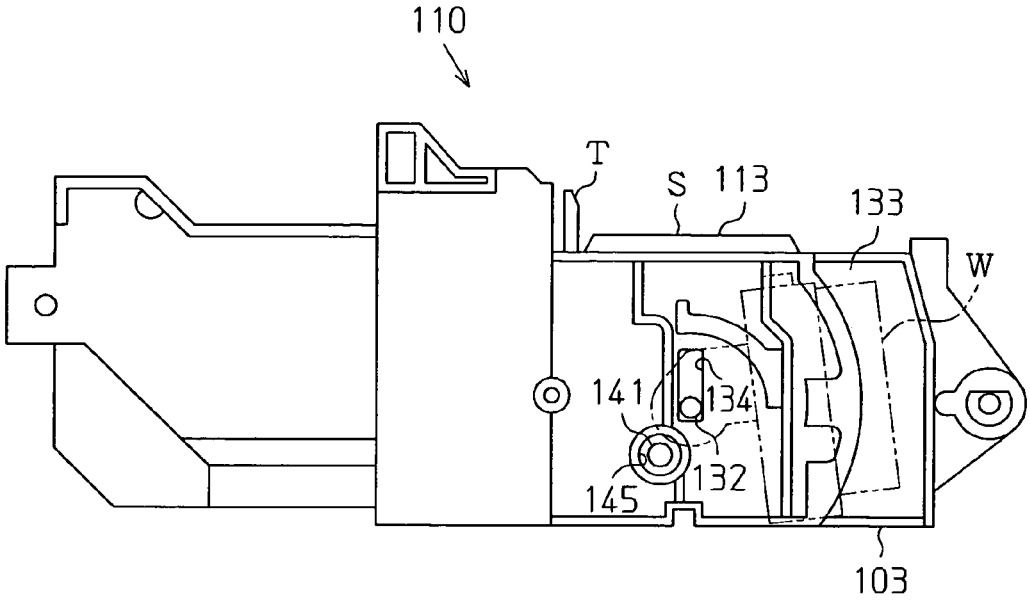
FIG. 22 is a side view explaining a standby state of the slider of FIG. 18.
Figure 23:
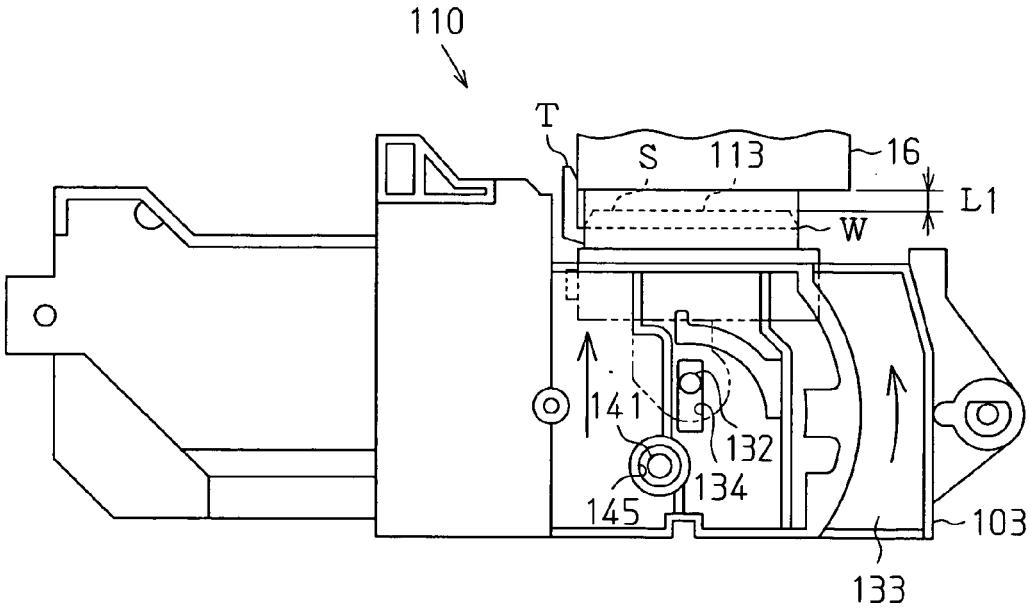
FIG. 23 is a side view explaining a flushing state of the slider of FIG. 18.
Figure 24:
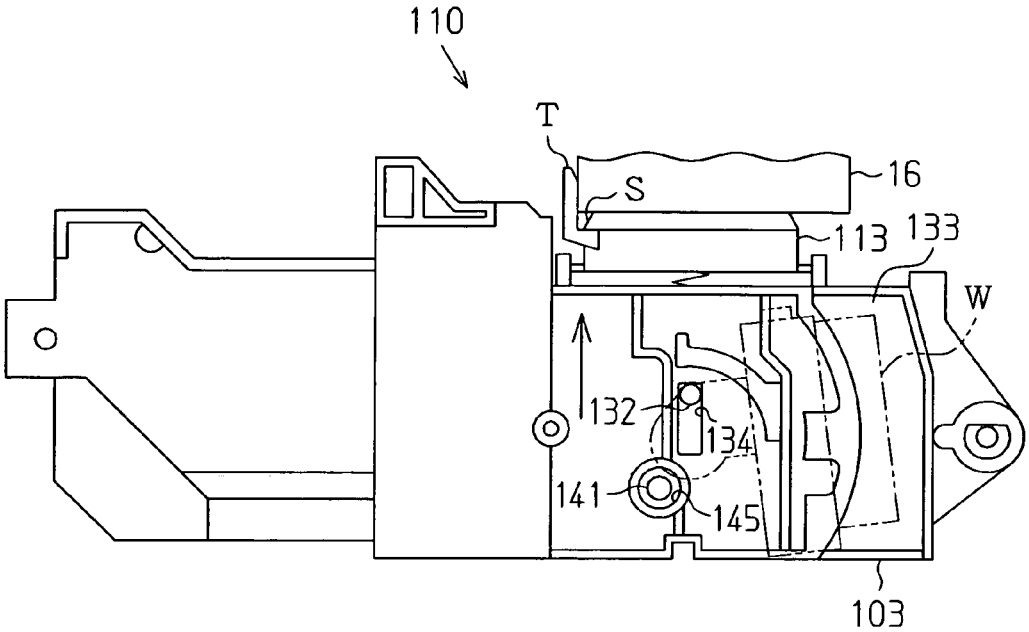
FIG. 24 is a side view explaining a capping state of the slider of FIG. 18.

The operation of the maintenance unit 110, configured as described above, will hereafter be explained, with reference to FIGS. 22 to 24.

As illustrated in FIG. 22, the slider 112 is located at the reference position (FIG. 16(*a*)) when held in the standby state.

To perform blank injection of ink from the nozzles of the recording head 16 toward the cap 113, which is called flushing, the carriage 101 is moved to the non-printing zone. The recording head 16 is thus placed in contact with the contact portion 129 of the slider 112. In this state, the slider 112 is located at the set position, as shown in FIG. 17(*a*). Accordingly, the extension T is moved forward (in direction +B) and contacts and supports the recording head 16. The cap 113 opposes the recording head 16.

When the recording head 16 is placed in contact with the contact portion 129 of the slider 112, the slider 112 is switched from the standby state to the flushing state. Further, the wiper W is moved out of the case 103 to the position at which the wiper W is allowed to contact the recording head 16. The wiper W wipes ink from the nozzle forming surface 16*a* of the recording head 16, when the recording head 16 passes over the wiper W for proceeding to the contact portion 129 of the slider 112. When the slider 112 is placed in the flushing state, the drive motor is stopped, such that the flushing state illustrated in FIG. 23 is maintained. At this stage, the cap 113 opposes the recording head 16 as spaced from the recording head 16 by a clearance L1. In this state, the flushing is performed as maintenance of the nozzles of the recording head 16.

To seal the recording head 16 in the state of FIG. 23, the inkjet recording device 100 switches the slider 112 first from the flushing state to the standby state and then to the capping state. As a result, with reference to FIG. 24, the slider 112 is located at a further upward position (in direction +H). The contact portion S of the cap 113 thus contacts the recording head 16, sealing the nozzle forming surface 16*a*. Accordingly, the nozzles are prevented from becoming dry.

The second embodiment has the following advantages.

When the carriage 101 is moved to the non-printing zone, the extension T is not located in the path of the recording head 16. The carriage 101 is thus prevented from contacting the extension T. This structure avoids noise generation due to an impact caused by the contact between the carriage 101 and the extension T. The inkjet recording device 100 is thus operated silently. Further, since the cap 113 is moved forward (in direction +B), the extension T is allowed to contact the recording head 16 at the set position. The cap 113 is thus accurately placed and held at the position opposing the recording head 16. Therefore, if the ink cartridge 102 retains pigment ink and reactant ink, the cap 113 reliably receives the ink discharged from the nozzles, allows the absorbers 113*a*, 113*b* to absorb the ink, and enables the ink to be discharged to the discharged ink reservoir 115.

When held in the flushing state, the cap 113, which is mounted on the slider 112, opposes the recording head 16 as spaced from the recording head 16 by the clearance L1. Thus, the extension T can be formed relatively short, as compared to the flushing guide extension 1080 of FIGS. 25 to 27. Accordingly, the layout of the maintenance unit 100 can be arranged with fewer limitations.

In the second embodiment, when the slider 112 is moved, the cap 113 is allowed to move forward (in direction +B). Further, the slider 112 is allowed to move along the height direction by means of the cam mechanism 140. This structure saves the space needed for moving the maintenance unit 110 to the position opposed to the recording head 16, as compared to the prior-art structure of FIGS. 25 to 27 in which the arm 1020 moves the cap unit 1030. It is thus possible to reduce the dimensions of the inkjet recording device 100 including the maintenance unit 110.

The present invention is not limited to the illustrated embodiments but may be varied in the following forms.

Figure 25:
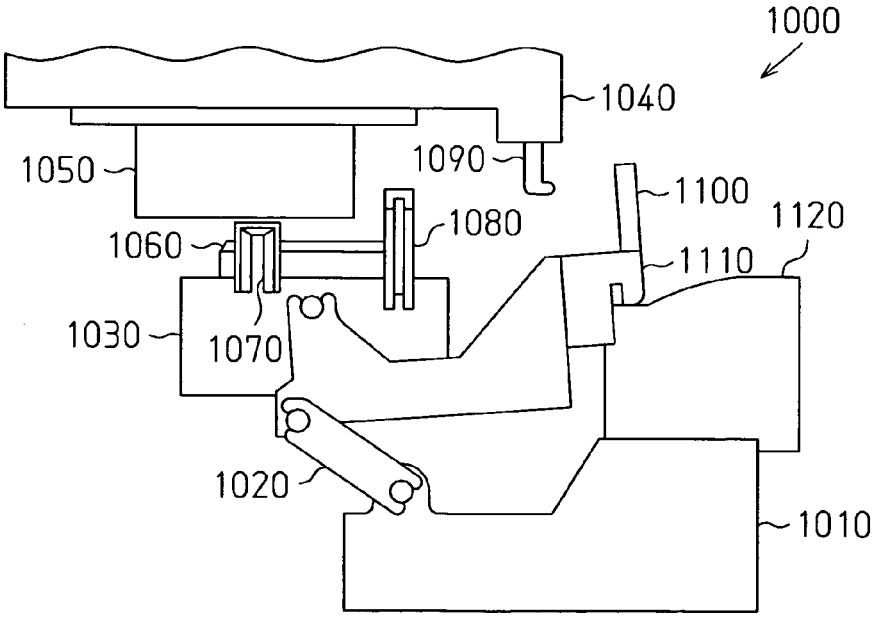
Fig. 25(Prior Art)
FIG. 25 is a side view schematically explaining a conventional maintenance unit.
Figure 26:
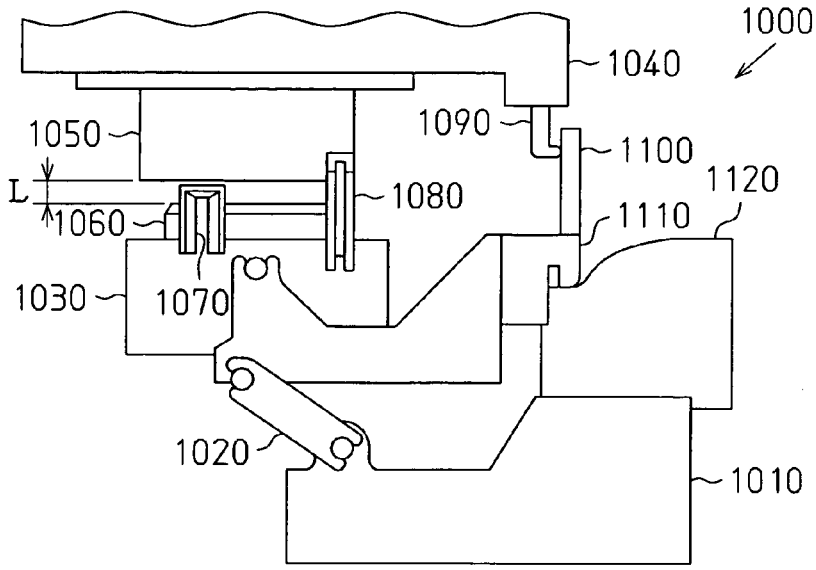
Fig. 26(Prior Art)
FIG. 26 is another side view schematically explaining the conventional maintenance unit.
Figure 27:
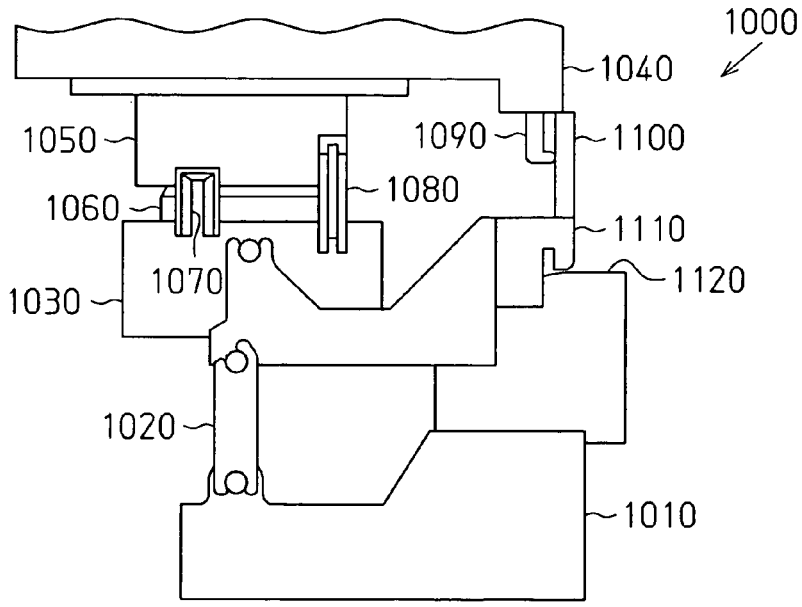
Fig. 27(Prior Art)
FIG. 27 is another side view schematically explaining the conventional maintenance unit.

In the embodiment of FIGS. 14 to 24, the maintenance unit 110 may be moved by the arm 1020 of FIGS. 25 to 27. If this is the case, it is preferred that the cap 113 is escaped from the path of the recording head 16 along the main scanning direction, preventing the recording head 16 from hitting the extension T.

In the embodiment of FIGS. 14 to 24, the extension T does not necessarily have to be provided.

The present invention may be embodied as a liquid injection apparatus other than the inkjet recording device 10 of FIG. 1 or the inkjet recording device 100 of FIG. 14. For example, the present invention may be embodied as a liquid injection apparatus for injecting liquid such as electrode material or coloring material, which is used in the manufacture of liquid crystal displays or EL displays or surface light emission displays. Further, the present invention may be embodied as a liquid injection apparatus for injecting biological organic substances, which is used in the production of biochips. In addition, the present invention may be embodied as a sample injecting device serving as a precision pipet.

As is clear to those skilled in the art, the present examples and embodiments are to be considered as illustrative and not restrictive and the invention is not to be limited to the details given herein, but may be modified within the scope and equivalence of the appended claims, without departing from the scope of the present invention.

The invention claimed is:

1. A liquid injection apparatus, comprising:

a liquid retaining portion for retaining liquid;

a liquid injecting head for injecting the liquid supplied from the liquid retaining portion in a predetermined injecting zone;

a cap for sealing the liquid injecting head outside the liquid injecting zone;

a support member extending from the cap; and a maintenance unit for discharging the liquid injected by the liquid injecting head through the interior of the cap, wherein, when the liquid injecting head is moved in the injecting zone, the cap is placed at a reference position at which the cap and the support member are escaped from the path of the liquid injecting head so that the support member is prevented from interfering with the liquid injecting head, and when the liquid injecting head is moved outside the liquid injecting zone, the cap is located at a set position at which the cap opposes the liquid injecting head and the support member contacts and supports a side surface of the liquid injecting head.

2. The liquid injection apparatus according to claim 1, wherein the maintenance unit includes a casing main body and a slider on which the cap is mounted, the slider being permitted to move with respect to the casing main body by contacting the liquid injecting head;

wherein the casing main body has a guide portion for supporting the cap at the reference position; and wherein the guide portion guides the cap to the set position in accordance with the movement of the slider with respect to the casing main body.

3. The liquid injection apparatus according to claim 2, wherein the cap has a positioning member that is capable of contacting the guide portion;

wherein, when supported by the guide portion with the positioning member, the cap is maintained at the reference position; and wherein, when guided by the guide portion with the positioning member, the cap is placed at the set position.

4. The liquid injection apparatus according to claim 2, wherein the slider is secured to the casing main body with a first urging member, the first urging member urging the slider toward the casing main body such that the cap is placed at the reference position.

5. The liquid injection apparatus according to claim 2, wherein a drive mechanism is provided in the casing main body, the driving mechanism reciprocating the slider vertically with respect to the casing main body.

6. The liquid injection apparatus according to claim 5, wherein the cap is secured to the slider with a second urging member urging the cap vertically, the slider including a guide member for vertically guiding the movement of the positioning member urged by the second urging member, the guide member restricting an upper limit of the vertical movement of the positioning member.

7. The liquid injection apparatus according to claim 1, wherein the interior of the cap is divided into at least two sections.

8. The liquid injection apparatus according to claim 7, wherein the liquid retaining portion retains a pigment ink and a reactant ink.

9. The liquid injection apparatus according to claim 1, wherein the support member contacts the side surface of the liquid injection head in a direction perpendicular to a moving direction of the liquid injection head.

* * * * *

UNITED STATES PATENT AND TRADEMARK OFFICE

CERTIFICATE OF CORRECTION

PATENT NO. : 7,284,818 B2
APPLICATION NO. : 10/817433
DATED : October 23, 2007
INVENTOR(S) : Atsushi Yoshida et al.

It is certified that error appears in the above-identified patent and that said Letters Patent is hereby corrected as shown below:

On Title Page item (73) Assignee:

Change "Sieko Epson Corporation, Tokyo (JP)" to --Seiko Epson Corporation, Tokyo (JP)--.

Signed and Sealed this

Eleventh Day of March, 2008

JON W. DUDAS
*Director of the United States Patent and Trademark Office*